US011217926B2

(12) United States Patent
Nehm

(10) Patent No.: US 11,217,926 B2
(45) Date of Patent: Jan. 4, 2022

(54) CONTACT ELEMENT HAVING A CONTACT BODY AND A SPRING ELEMENT ARRANGED THEREON

(71) Applicant: Phoenix Contact GmbH & Co. KG, Blomberg (DE)

(72) Inventor: Detlef Nehm, Schieder-Schwalenberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/967,433

(22) PCT Filed: Mar. 7, 2019

(86) PCT No.: PCT/EP2019/055756
§ 371 (c)(1),
(2) Date: Aug. 5, 2020

(87) PCT Pub. No.: WO2019/175027
PCT Pub. Date: Sep. 19, 2019

(65) Prior Publication Data

US 2021/0218172 A1 Jul. 15, 2021

(30) Foreign Application Priority Data

Mar. 16, 2018 (BE) ..... 2018/5169

(51) Int. Cl.
*H01R 13/11* (2006.01)
*H01R 4/48* (2006.01)
(Continued)

(52) U.S. Cl.
CPC ..... *H01R 13/111* (2013.01); *H01R 4/4836* (2013.01); *H01R 11/05* (2013.01); *H01R 13/405* (2013.01)

(58) Field of Classification Search
CPC ... H01R 13/111; H01R 13/405; H01R 13/113; H01R 13/114; H01R 11/05; H01R 4/4836; H01R 4/4845; H01R 4/4818
See application file for complete search history.

(56) References Cited

U.S. PATENT DOCUMENTS 6,336,824 B1 * 1/2002 Sorig ..... H01R 4/4836 439/441
7,544,103 B2 * 6/2009 Walter ..... H01R 4/4836 439/441

FOREIGN PATENT DOCUMENTS

DE 19838008 A1 3/1999
DE 20208724 U1 10/2003
(Continued)

*Primary Examiner* — Briggitte R. Hammond
(74) *Attorney, Agent, or Firm* — Leydig, Voit & Mayer, Ltd.

(57) ABSTRACT

A contact element includes: an electrical contact portion for plug-in connection to an associated mating contact element; a contact body connected to the contact portion and forming an insertion space into which an electrical conductor is insertable in an insertion direction for electrical connection to the contact element; and a spring element which is arranged on the contact body and has a first spring leg for bearing on the contact body and a second spring leg for interacting with the electrical conductor inserted into the insertion space. The first spring leg is interlockingly connectable to the contact body by being placeable with an opening on a fastening device of the contact body.

14 Claims, 7 Drawing Sheets

(51) Int. Cl.
*H01R 11/05* (2006.01)
*H01R 13/405* (2006.01)

(56) References Cited

FOREIGN PATENT DOCUMENTS

| | | | |
|---|---|---|---|
| DE | 102012219741 | A1 | 4/2014 |
| DE | 202017103185 | U1 | 9/2017 |
| EP | 1555723 | A1 | 7/2005 |
| EP | 3029776 | A1 | 6/2016 |

* cited by examiner

CONTACT ELEMENT HAVING A CONTACT BODY AND A SPRING ELEMENT ARRANGED THEREON

CROSS-REFERENCE TO PRIOR APPLICATIONS

This application is a U.S. National Phase application under 35 U.S.C. § 371 of International Application No. PCT/EP2019/055756, filed on Mar. 7, 2019, and claims benefit to Belgian Patent Application No. BE 2018/5169, filed on Mar. 16, 2018. The International Application was published in German on Sep. 19, 2019 as WO 2019/175027 under PCT Article 21(2).

FIELD

The present invention relates to a contact element and to a method for manufacturing a contact element.

BACKGROUND

Such a contact element includes an electrical contact portion for plug-in connection to an associated mating contact element, a contact body connected to the contact portion and forming an insertion space into which an electrical conductor can be inserted in an insertion direction for electrical connection of a contact element, and a spring element which is arranged on the contact body (10) and has a first spring leg for bearing on the contact body and a second spring leg for interacting with an electrical conductor inserted into the insertion space.

The contact portion may be configured, for example, as a socket contact or as a pin contact and allows plug-in connection to an associated complementary mating contact portion. On the other hand, the contact body forms an insertion space into which an electrical conductor can be inserted with a stripped conductor end, thus allowing the electrical conductor to be connected to the contact element. Via the spring element, an electrical conductor inserted into the insertion space is mechanically fixed and also electrically contacted to the contact element.

It is desirable to provide a contact element that has few components, is easy to assemble and thus cost-effective to manufacture.

In a connecting terminal known from DE 198 38 008 A1, clamping legs are cut free from the wall of a quick-connect terminal and extend into the interior thereof.

In a spring terminal known from DE 202 08 724 U1, a spring element is arranged on a terminal cage.

SUMMARY

In an embodiment, the present invention provides a contact element, comprising: an electrical contact portion for plug-in connection to an associated mating contact element; a contact body connected to the contact portion and forming an insertion space into which an electrical conductor is insertable in an insertion direction for electrical connection to the contact element; and a spring element which is arranged on the contact body and has a first spring leg configured to bear on the contact body and a second spring leg configured to interact with the electrical conductor inserted into the insertion space, wherein the first spring leg is interlockingly connectable to the contact body by being placeable with an opening on a fastening device of the contact body.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
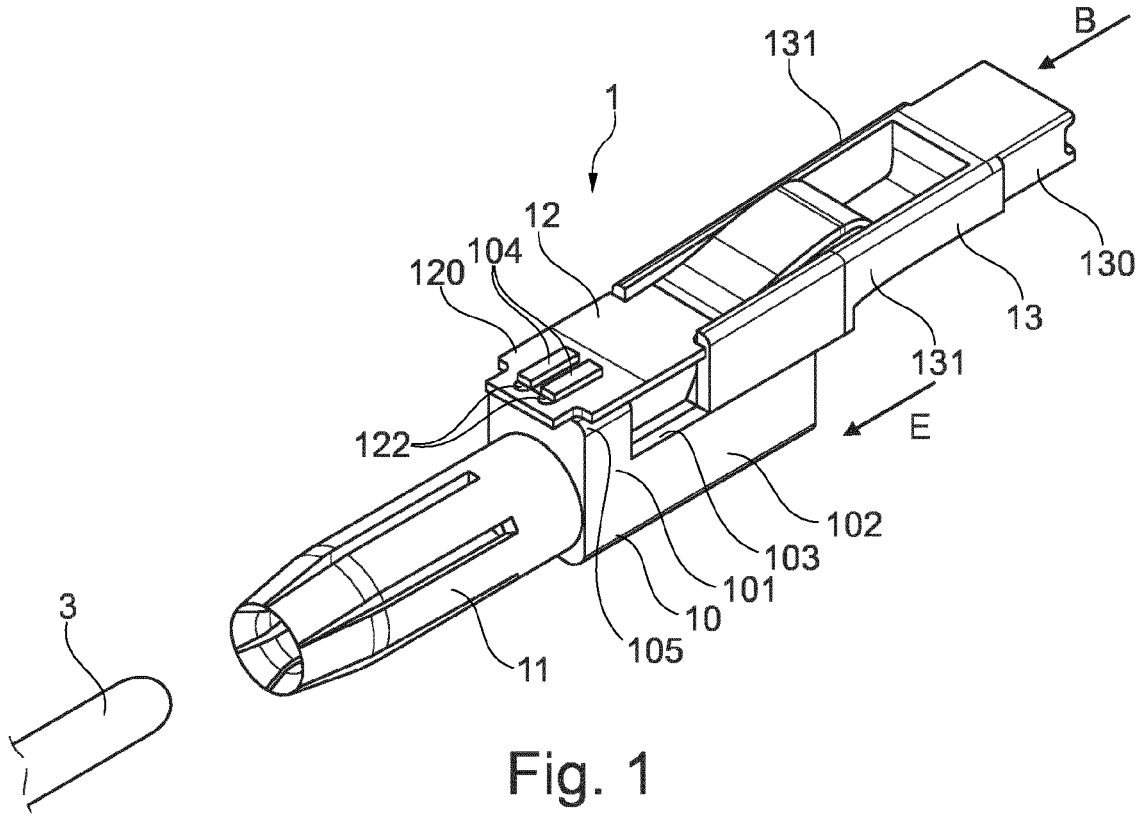
FIG. 1 is a view of an exemplary embodiment of a contact element.
Figure 2:
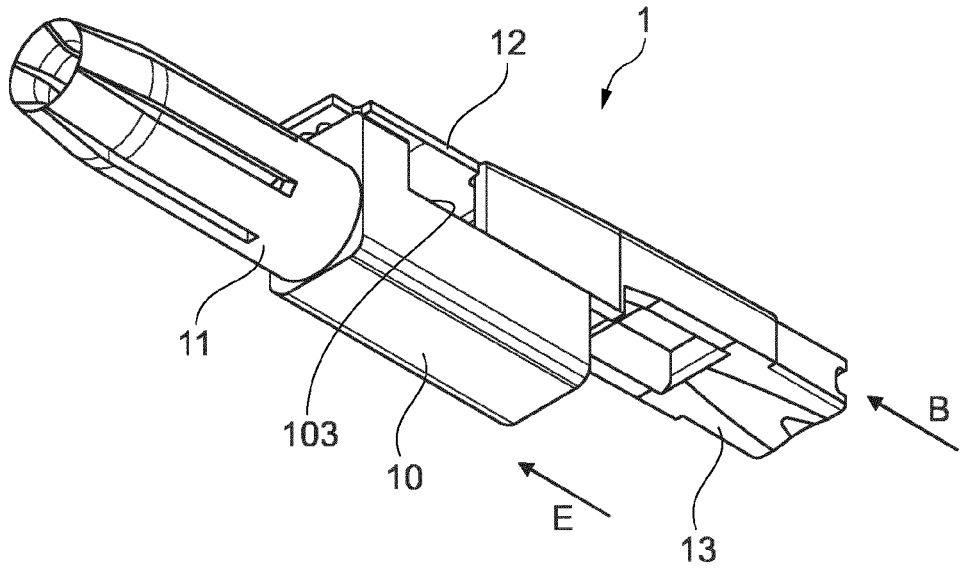
FIG. 2 is a different view of the contact element.
Figure 3:
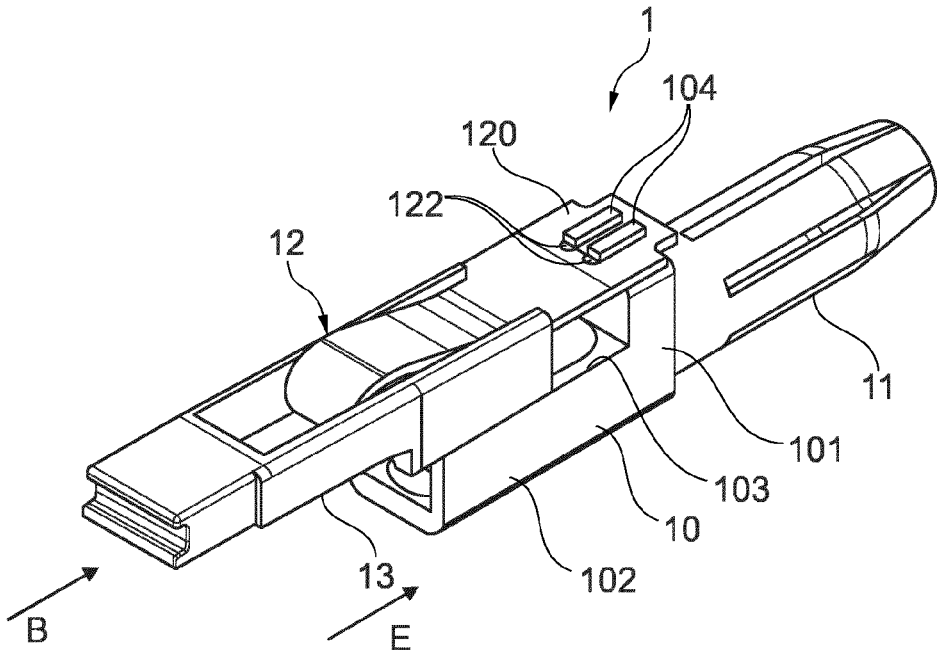
FIG. 3 is another view of the contact element.
Figure 4:
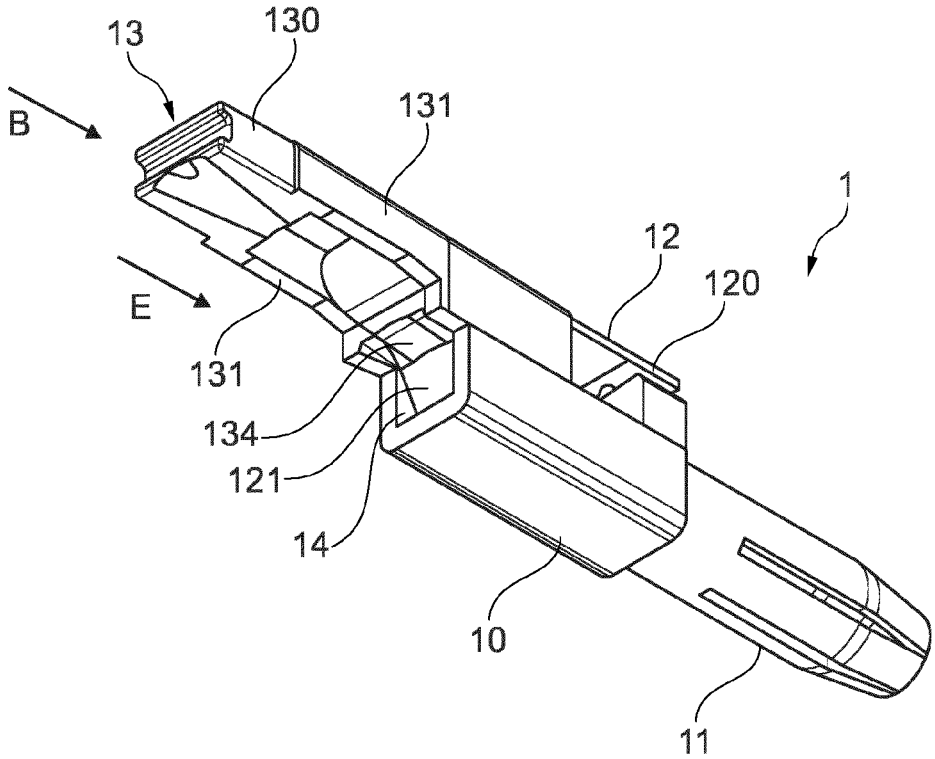
FIG. 4 is yet another view of the contact element.
Figure 5:
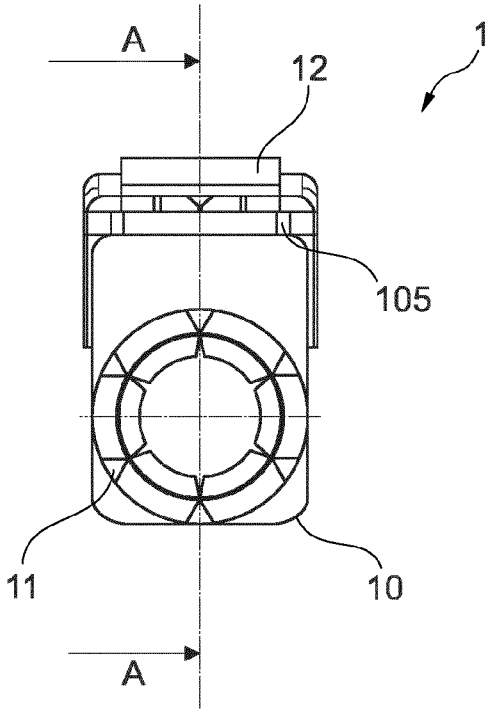
FIG. 5 is a frontal view of the contact element.

In an embodiment, the present invention provides a contact element and a method for manufacturing a contact element which will allow for simple and inexpensive manufacture of the contact element.

Accordingly, the first spring leg is interlockingly connectable to the contact body by being placeable with an opening on a fastening device of the contact body.

Accordingly, the first spring leg, and thereby the spring element, is to be interlockingly connected to the contact body by bringing the first spring leg into engagement with a fastening device of the contact body. In an assembled position, the fastening device extends through an opening of the first spring leg and thereby fixedly secures the first spring leg, and thus the spring element, to the contact body.

Thus, in the assembled position, the first spring leg is fixedly connected to the contact body via the fastening device. Consequently, in the assembled position, an integral unit is provided which, in some instances, may also be used without a surrounding housing.

In an embodiment, in a pre-assembled condition of the contact element, the first spring leg is placeable with its opening on the fastening device of the contact body. Thus, in the pre-assembly position, the first spring leg can be brought, with its opening, into engagement with the fastening device of the contact body so as to connect the spring element to the contact body. After placement of the spring leg on the contact body, the fastening device can then be plastically deformed by bending it over or plastically deforming it in a different way so that a fixed, load-bearing interlocking connection is produced between the spring element and the contact body.

The fastening device may be in the form of, for example, a fastening tab and may project from a wall of the contact body. However, the fastening device may also be formed on the contact body as another form of projecting material. In order to produce the interlocking connection, the fastening device is plastically and thus permanently deformed in such a way that the first spring leg, and thereby the spring element, is firmly and fixedly secured to the contact body, and such that it is capable of bearing loads.

In the assembled condition, the first spring leg preferably rests flat on a mounting portion of the contact body. The fastening device may be formed on the mounting portion and project therefrom so that by placing the first spring leg on the mounting portion, the fastening device can be brought into engagement with the opening of the first spring leg to thereafter fix the connection between the first spring leg and the contact body by plastic deformation at the fastening device.

The contact body may, for example, be formed together with the contact portion from a solid body by machining, such as by milling. Alternatively, the contact body and the contact portion may also be formed together as a stamped and bent sheet metal part.

In an embodiment, the contact body has a front end wall extending perpendicularly to the insertion direction in which an electrical conductor can be inserted into the insertion space and bounding the insertion space in the insertion direction. Thus, an electrical conductor cannot be inserted into the insertion space beyond the front end wall, so that the front end wall provides push-through protection, which makes it impossible to push an electrical conductor from the insertion space into the area of the contact portion.

The front end wall may, for example, form the mounting portion on which the first spring leg is to be placed. The mounting portion may be formed, for example, on a flat outer surface of the front end wall, for example at a top side opposite a bottom wall of the contact body. The fastening device is preferably formed on the front end wall, namely at the mounting portion formed on the front end wall, so that the first spring leg of the spring element can be interlockingly connected to the contact body by placing it on the mounting portion of the front end wall.

In an alternative embodiment, push-through protection may also be provided by the spring element. In this case, the first spring leg may, for example, be adjoined by a leg section that bounds the insertion space in the insertion direction. This leg section is formed at an end of the first spring leg remote from the second spring leg and is, for example, bent over relative to the first spring leg, for example at an angle of approximately 90°.

The contact body preferably has at least one fastening device, for example two fastening devices in the form of fastening tabs. When in place, the fastening devices extend through the first spring leg and can be plastically deformed such that after plastic deformation, for example after having been bent over or deformed as in a riveting operation, a fixed, load-bearing connection is provided between the first spring leg and the contact body.

While the spring element is to be disposed with the first spring leg on the contact body of the contact element and to be connected to the contact body, the second spring leg serves to lock an electrical conductor inserted into the insertion space of the contact body mechanically in place on the contact body and also to electrically contact it to the contact body. The first spring leg and the second spring leg may be bent over relative to each other so that they form an acute angle therebetween, the second spring leg being elastically adjustable in position relative to the first spring leg to allow an electrical conductor to be attached to the contact body and, when the electrical conductor is attached, to act under elastic preload on the electric conductor to fixedly secure it to the contact body and electrically contact it to the contact body.

In an embodiment, the contact element additionally has an actuating element for changing the position of the second spring leg in the insertion space. Such an actuating element can be operated to change the position of the second spring leg so that an electrical conductor can be easily attached to the contact body and an electrical conductor attached to the contact body can be removed from the contact body. By operating the actuating element, the second spring leg may, for example, be dislodged from a bottom wall of the contact body so that the space between the second spring leg and the bottom wall of the contact body is enlarged, and thus, an electrical conductor can be easily inserted into the insertion space and an attached conductor can be easily removed from the insertion space.

The actuating element is, for example, supported on the contact body such that it is movable along an actuating direction. Thus, the actuating element can be moved in a defined manner relative to the contact body and has, for example, an actuating portion by which the actuating element acts on the second spring leg of the spring element in order to change the position of the second spring leg in the insertion space.

In an embodiment, the actuating element has a head and two legs extending parallel to each other from the head. The legs accommodate the spring element therebetween and are each guided on side walls of the contact body so that the actuating element is movable via the legs in a defined manner relative to the contact body.

One or both legs may have latching portions formed thereon by which the actuating element can be connected to the spring element. This makes it possible, for example, to place the actuating element on the spring element prior to connecting the spring element to the contact body so that the spring element and the actuating element attached and captively held thereto can be connected together to the contact body. Thus, for purposes of assembly, the spring element and the actuating element are placed together on the contact body and interlockingly connected to the contact body via the fastening device, which can simplify handling during assembly.

The latching portions are formed, for example, as projections protruding inwardly from the legs and engage behind the first spring leg and/or the second spring leg of the spring element, thus providing a captive connection between the spring element and the actuating element.

The object is also achieved by a method for manufacturing a contact element, in which there is provided an electrical contact portion for plug-in connection to an associated mating contact element and a contact body connected to the contact portion and forming an insertion space into which an electrical conductor can be inserted in an insertion direction for electrical connection to the contact element. A spring element is arranged on the contact body in such a way that the spring element bears with a first spring leg on the contact body and extends with a second spring leg into the insertion space to interact with an electrical conductor inserted into the insertion space. Provision is made for the first spring leg to be interlockingly connected to the contact body by being placing the first spring leg with an opening on a fastening device of the contact body.

The advantages and advantageous embodiments described above with respect to the contact element are analogously applicable to the method, and thus, reference is made to the above discussion.

To connect the spring element to the contact body, the first spring leg is placed on the fastening device of the contact body, whereupon the fastening device, e.g., in the form of a fastening tab, is preferably plastically deformed, thus providing an interlocking, fixed connection between the first spring leg and the contact body.

Such a connection provided by plastic deformation may, for example, be formed similar to a riveted connection. Thus, via the connection, the first spring leg is fixedly and permanently connected to the contact body.

FIGS. 1 through 12 show views of a first exemplary embodiment of a contact element 1 having a contact body 10 and a contact portion 11 formed thereon in the shape of a contact socket and serving for plug-in connection to an associated mating contact element 3 (see FIG. 1).

Contact element 1 is formed, for example, by machining from a solid body.

Figure 6:
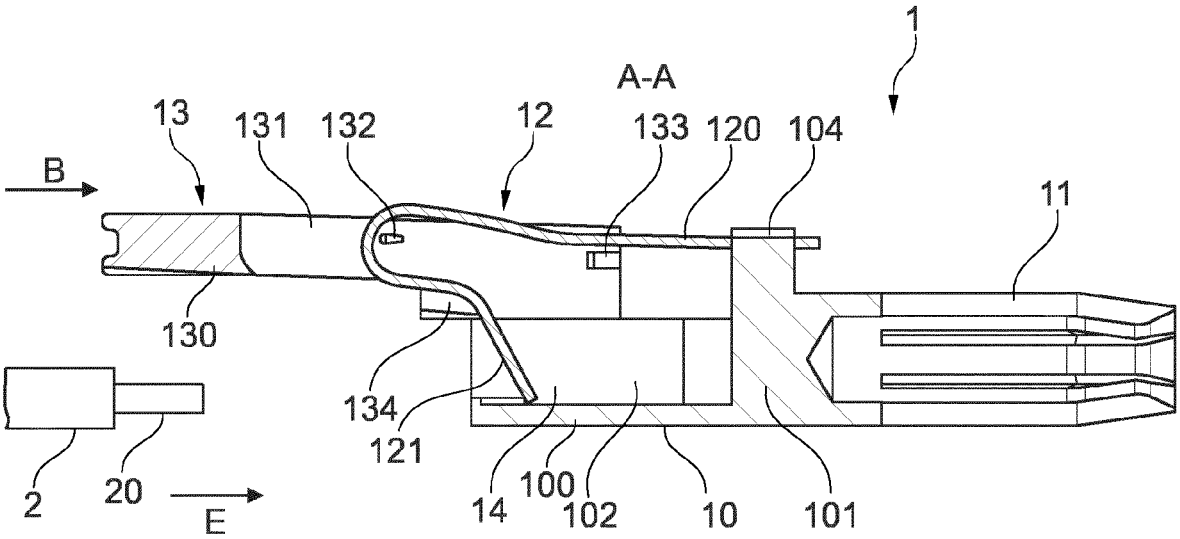
FIG. 6 is a sectional view taken along line A-A in FIG. 5.

As can be seen, for example, from the sectional view of FIG. 6, contact body 10 has a bottom wall 100 and side walls 102 formed on both sides of bottom wall 100, which together form an insertion space 14 into which an electrical conductor 2 can be inserted with a stripped conductor end 20 in an insertion direction E to thereby connect electrical conductor 2 to contact element 1. Insertion space 14 is bounded in insertion direction E by a front end wall 101 that extends perpendicularly to insertion direction E and closes insertion space 14 on the inside toward contact portion 11, so that electrical conductor 2 cannot be inserted beyond insertion space 14 into the area of contact portion 11.

Arranged on contact body 10 is a spring element 12 in the form of a leg spring, which is disposed with a first spring leg 120 on a mounting portion 105 on the top of front end wall 101 and extends with a second spring leg 121 into the area of insertion space 14, the second spring leg being bent over relative to first spring leg 120. Second spring leg 121 is elastically adjustable relative to first spring leg 120 and serves to lock an electrical conductor 2 inserted into insertion space 14 mechanically in place on contact body 10 and also to electrically contact it to contact body 10 so that an electrical conductor 2 inserted into insertion space 14 is mechanically firmly held to contact element 1 and also electrically connected to contact element 1.

An actuating element 13 in the form of a slider is supported on contact body 10 such that it is movable on guideways 103 in side walls 102 of contact body 10 along an actuating direction B parallel to insertion direction E. Actuating element 13 has a head 130 and legs 131 extending parallel to each other from head 130, the legs being disposed on both sides of spring element 12 and movably supported on guideways 103 of side walls 102 of contact body 10.

Extending transversely between legs 131 is an actuating portion 134 (see, for example, FIG. 4 in conjunction with FIG. 6), via which actuating element 13 is operatively connected to second spring leg 121 in such a way that when actuating element 13 is moved in actuating direction B toward contact body 10, a force is exerted on second spring leg 21, lifting it from bottom wall 100, so that an electrical conductor 2 can be easily inserted into insertion space 14 and an electrical conductor 2 attached to contact body 10 can be easily removed from insertion space 14.

In the exemplary embodiment shown, spring element 12 is placed with its first spring leg 120 on mounting portion 105 on the top of front end wall 101 of contact body 10 and interlockingly connected to mounting portion 105 via a fastening device 104.

Figure 10:
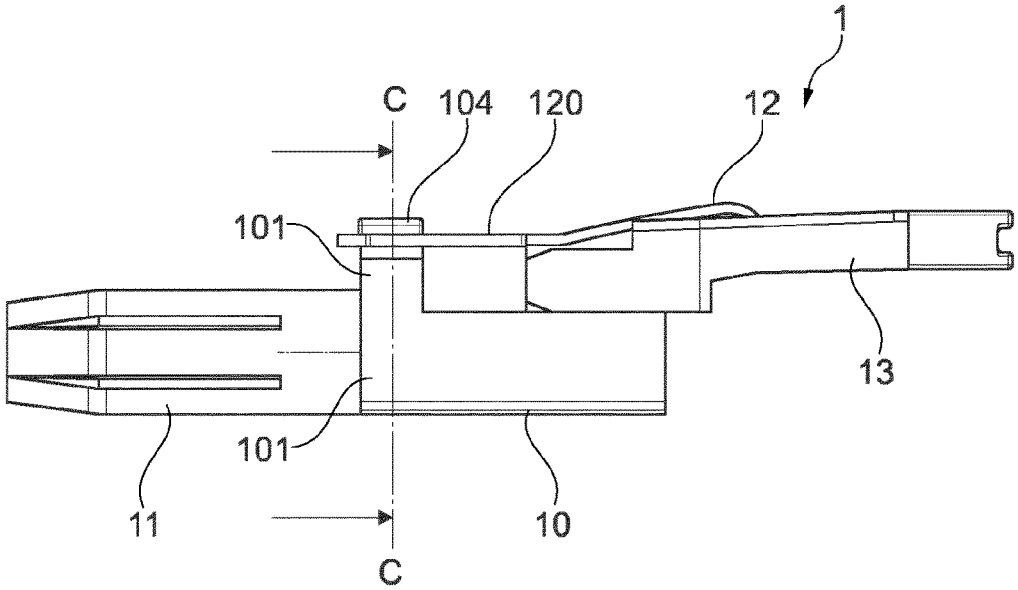
FIG. 10 is a side view showing the contact element in a pre-assembly position.
Figure 11:
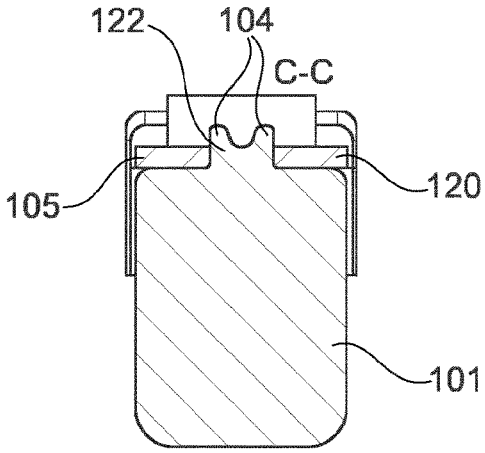
FIG. 11 is a sectional view taken along line C-C in FIG. 10.
Figure 12:
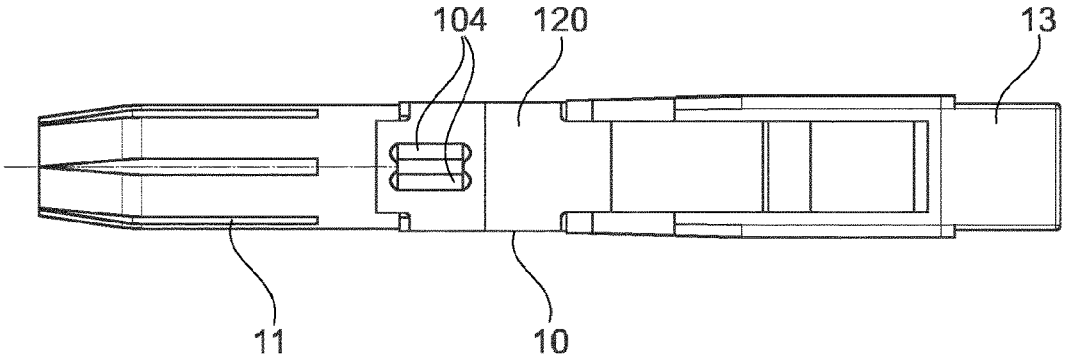
FIG. 12 is a plan view showing the contact element in the pre-assembly position.
Figure 13:
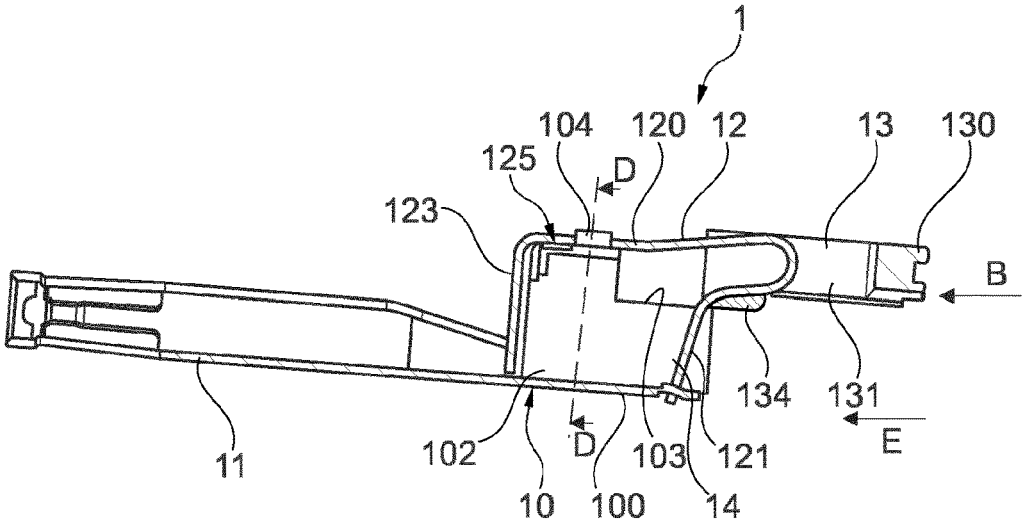
FIG. 13 is a sectional view of a further exemplary embodiment of a contact element, shown in a pre-assembly position.
Figure 14:
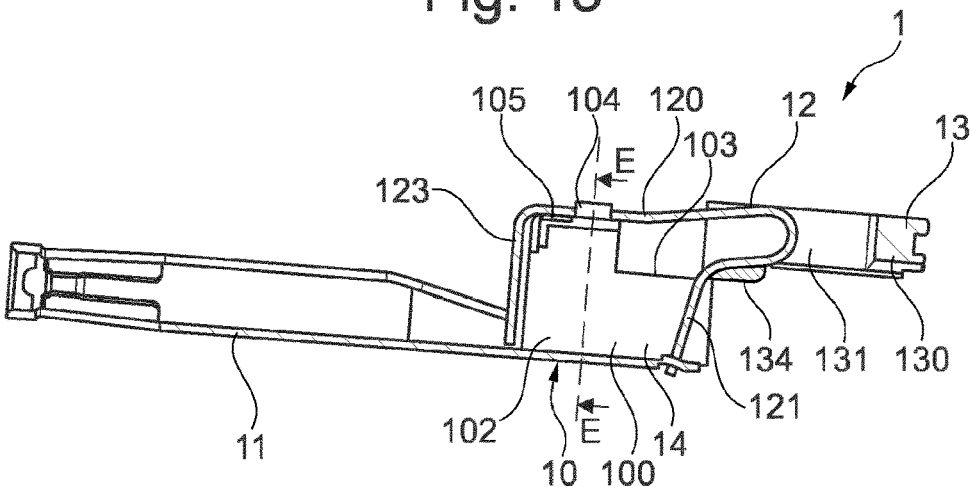
FIG. 14 is a sectional view showing the contact element in an assembled position.
Figure 15:
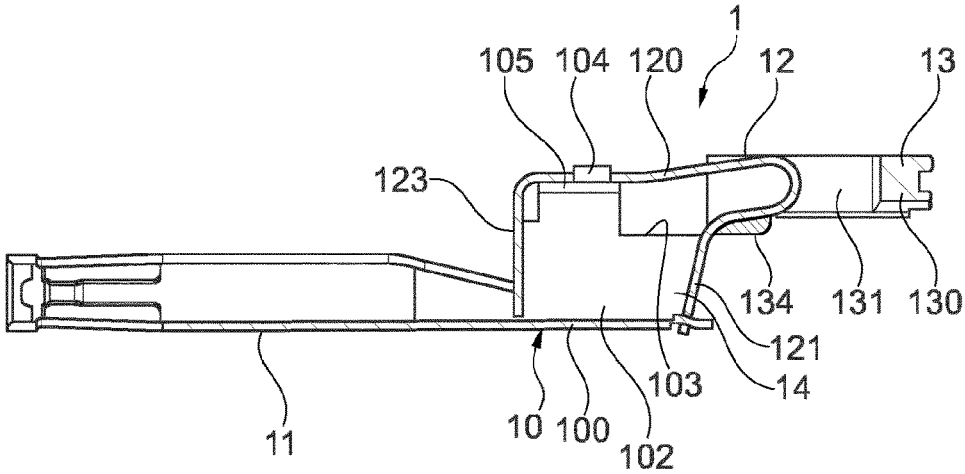
FIG. 15 is another sectional view showing the contact element in the assembled position.
Figure 16:
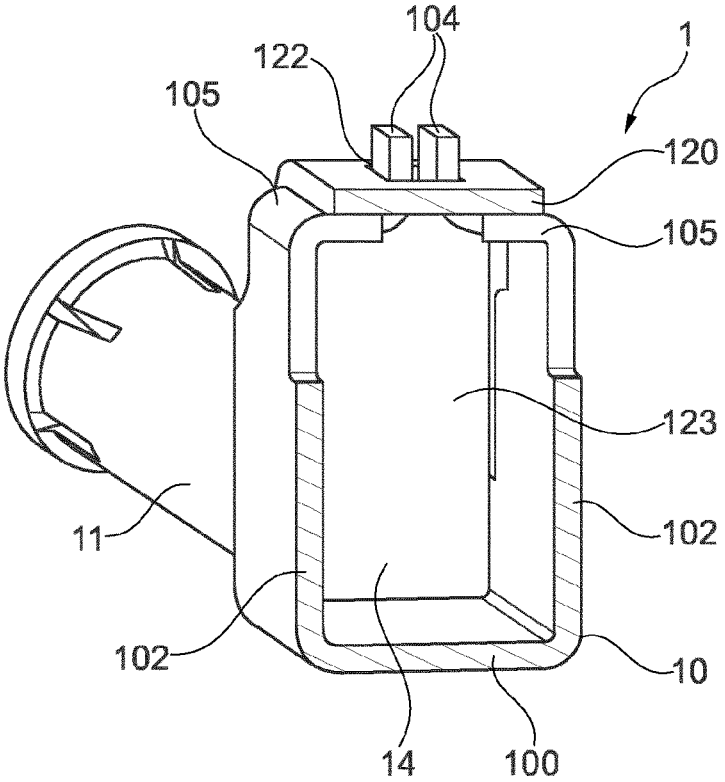
FIG. 16 is a sectional view taken along line D-D in FIG. 13.
Figure 17:
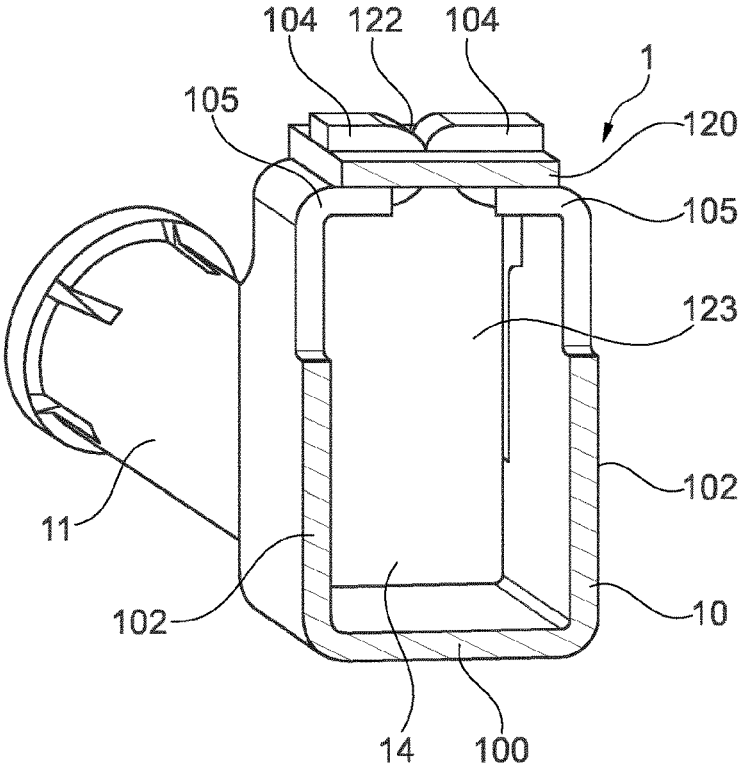
FIG. 17 is a sectional view taken along line E-E in FIG. 14.

In a pre-assembled condition, shown in FIGS. 10 through 12, fastening device 104, which is provided by projecting material, is shaped such that first spring leg 120 can be placed with an opening 122 on fastening device 104 in such a way that fastening device 104 extends through opening 122, as can be seen, for example, from the sectional view of FIG. 11.

Figure 7:
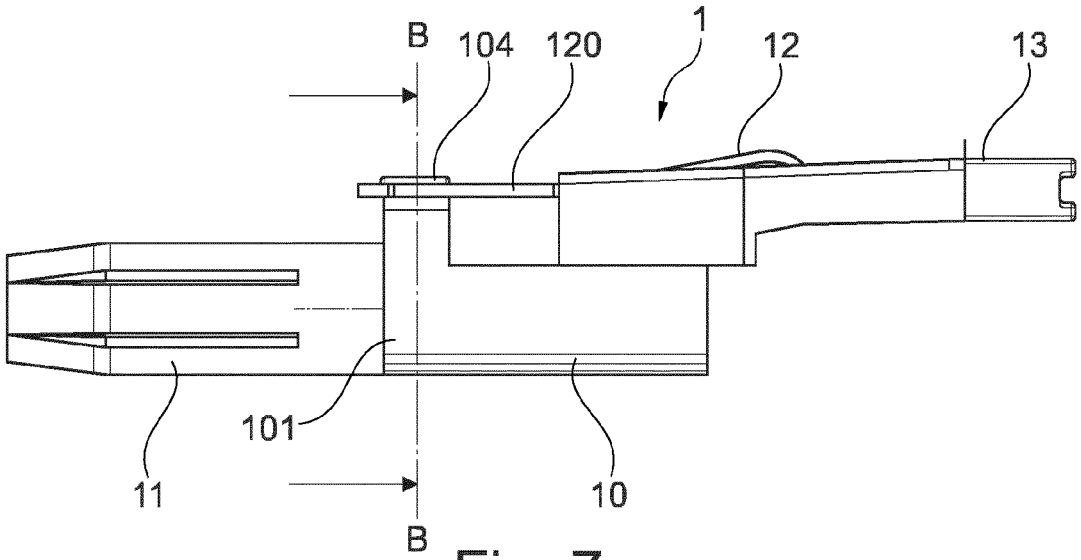
FIG. 7 is a side view of the contact element.
Figure 8:
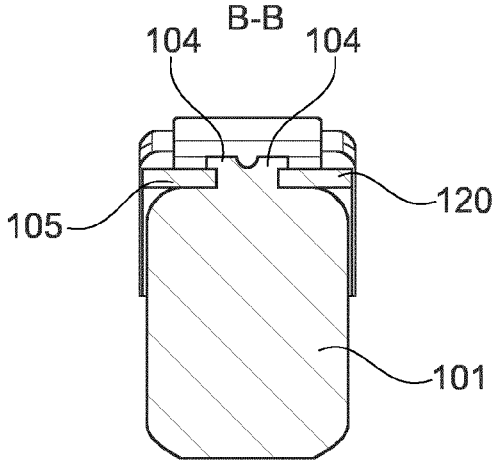
FIG. 8 is a sectional view taken along line B-B in FIG. 7.
Figure 9:
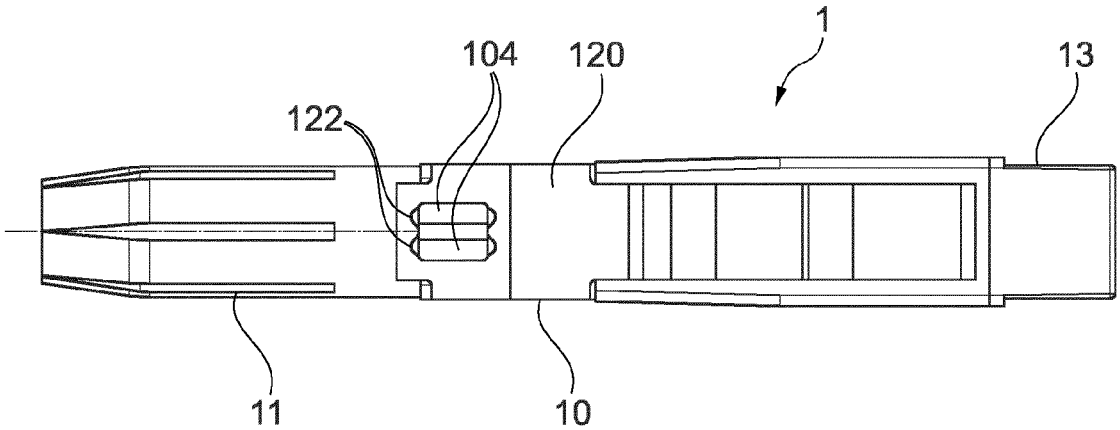
FIG. 9 is a plan view of the contact element.

After that, fastening device 104 is plastically deformed so that a fixed connection similar to a riveted connection is provided between first spring leg 120 and contact body 10, as illustrated in FIGS. 7 through 9. Thus, in an assembled position, spring element 12 is fixedly and permanently connected via its first spring leg 120 to contact body 10, namely to front end wall 101 of contact body 10, so that a load-bearing connection is provided between spring element 12 and contact body 10.

For purposes of assembly, spring element 12 and actuating element 13 may be placed together on contact body 10. For this purpose, latching portions 132, 133 in the form of latching projections are formed on the inner sides of legs 131 of actuating element 13, as can be seen from the sectional view of FIG. 6. Prior to connecting spring element 12 to contact body 10, actuating element 13 is held to spring element 12 via latching portions 132, 133, so that actuating element 13 can be placed together with spring element 12 on contact body 10 and is mounted to contact body 10 by fixing first spring leg 120 in place.

Alternatively, it is possible to first connect spring element 12 to contact body 10 without the actuating element 13 attached thereto, and to then attach actuating element 13 to the spring element 12 already in place on contact body 10.

In another exemplary embodiment, shown in FIGS. 13 through 17, contact body 10 and contact portion 11 are formed together as a stamped and bent sheet metal part. In this case, spring element 12 can be placed on mounting portions 105, which are bent inwardly in the manner of tabs from side walls 102 of contact body 10 (see FIG. 16), and in such a way that fastening devices 104 in the form of tabs formed on mounting portions 105 extend through an opening 122 in first spring leg 120, as can be seen, for example, from FIG. 16.

In a pre-assembly position, the fastening devices 104 formed as tabs on mounting portions 105 extend straight up so that first spring leg 120 can be placed on fastening devices 104 from above. After that, the fastening devices 104 in the form of tabs are bent over, as can be seen from FIGS. 14, 15 and 17, thus providing a fixed permanent connection between mounting portions 105 of contact body 10 and first spring leg 120.

Again, an actuating element 13 is guided on contact body 10 along an actuating direction B and is operatively connected via an actuating arm 134 to second spring leg 21 of spring element 12 such that, by displacing actuating element 13, second spring leg 121 can be repositioned in the insertion space 14 formed within contact body 10.

In the exemplary embodiment shown, first spring leg 120 is adjoined by a leg section 123 that provides push-through protection for insertion space 14. Leg section 123 is formed at an end of first spring leg 120 remote from second spring leg 121 and is bent over relative to first spring leg 120 at an angle of 90° so that leg section 123 extends perpendicularly to insertion direction E and bounds insertion space 14 at its end facing contact portion 11 such that an electrical conductor 2 cannot be inserted in insertion direction E beyond leg section 123 into the area of contact portion 11.

Apart from that, the embodiment illustrated in FIGS. 13 through 17 is functionally identical to that described earlier with reference to FIGS. 1 through 12, and thus, reference is made to the discussion above.

The concept underlying the invention is not limited to the above-described embodiments, but may also be implemented in a completely different way.

Because the spring element is fixedly connected to the contact body via its first spring leg by plastic deformation of a fastening device, for example, in a manner similar to a riveted connection, there is provided ease of manufacture and also ease of handling after assembly.

Since the spring element is fixedly connected to the contact body, it is generally possible to dispense with an enclosing housing. In particular, such an enclosing housing is not needed to connect the spring element to the contact body.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 contact element
10 contact body
100 bottom wall
101 front end wall
102 side wall
103 guideway
104 fastening device
105 fastening portion
11 contact portion (contact socket)
12 spring element
120 spring leg
121 spring leg
122 opening
123 leg section
13 actuating element
130 head
131 leg
132, 133 latching portion
134 actuating portion
14 insertion space
2 conductor
20 conductor end
3 mating contact element
B actuating direction
E insertion direction

The invention claimed is:

1. A contact element, comprising:

an electrical contact portion for plug-in connection to an associated mating contact element;

a contact body connected to the contact portion and forming an insertion space into which an electrical conductor is insertable in an insertion direction for electrical connection to the contact element, the contact body including a fastening device; and a spring element which is arranged on the contact body and has a first spring leg configured to bear on the contact body and a second spring leg configured to interact with the electrical conductor inserted into the insertion space, the first spring leg including an opening;

wherein in a pre-assembled condition of the contact element, the opening of the first spring leg is placeable on the fastening device and, in an assembled condition, the fastening device is plastically deformed as compared to the pre-assembled condition to produce an interlocking connection, such that the first spring leg is interlockingly connectable to the contact body by being placeable with the opening on the fastening device of the contact body.

2. The contact element as recited in claim 1, wherein in the assembled condition, the first spring leg rests flat on a mounting portion of the contact body, the fastening device being formed on the mounting portion.

3. The contact element as recited in claim 1, wherein the insertion space is bounded in the insertion direction by a front end wall of the contact body that extends perpendicularly to the insertion direction.

4. The contact element as recited in claim 3, wherein the fastening device is formed on the front end wall.

5. The contact element as recited in claim 1, wherein the first spring leg is adjoined at an end remote from the second spring leg by a leg section that bounds the insertion space in the insertion direction.

6. The contact element as recited in claim 5, wherein the leg section is bent over relative to the first spring leg.

7. The contact element as recited in claim 1, wherein the contact body has two fastening devices and the first spring leg has two openings configured to produce the interlocking connection.

8. The contact element as recited in claim 1, wherein the first spring leg and the second spring leg are bent over relative to each other.

9. The contact element as recited in claim 1, further comprising an actuating element configured to change a position of the second spring leg in the insertion space.

10. The contact element as recited in claim 9, wherein the actuating element is supported on the contact body such that it is movable along an actuating direction.

11. The contact element as recited in claim 9, wherein the actuating element has a head and two legs extending parallel to each other from the head, the legs at least partially embracing the spring element therebetween.

12. The contact element as recited in claim 11, wherein the actuating element has at least one latching portion on at least one leg for latching connection to the spring element.

13. A method for manufacturing a contact element, comprising:

providing an electrical contact portion for plug-in connection to an associated mating contact element;

providing a contact body connected to the contact portion and forming an insertion space into which an electrical conductor is insertable in an insertion direction for electrical connection to the contact element; and arranging a spring element on the contact body such that the spring element bears with a first spring leg on the contact body and extends with a second spring leg into the insertion space to interact with the electrical conductor inserted into the insertion space;

placing an opening through the first spring leg on a fastening device of the contact body; and plastically deforming the fastening device extending through the opening to interlockingly connect the first spring leg to the contact body.

14. A contact element, comprising:

an electrical contact portion for plug-in connection to an associated mating contact element;

a contact body connected to the contact portion and forming an insertion space into which an electrical conductor is insertable in an insertion direction for electrical connection to the contact element; and a spring element which is arranged on the contact body and has a first spring leg configured to bear on the contact body and a second spring leg configured to interact with the electrical conductor inserted into the insertion space, wherein the first spring leg is interlockingly connectable to the contact body by being placeable with an opening on a fastening device of the contact body, wherein the insertion space is bounded in the insertion direction by a front end wall of the contact body that extends perpendicularly to the insertion direction, and wherein the fastening device is formed on the front end wall.

* * * * *